US006305502B1

(12) United States Patent
He et al.

(10) Patent No.: US 6,305,502 B1
(45) Date of Patent: Oct. 23, 2001

(54) ELEVATOR CAB FLOOR ACCELERATION CONTROL SYSTEM

(75) Inventors: Thomas He, Unionville; Thomas Francis Malone, Jr., Avon, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/469,123

(22) Filed: Dec. 21, 1999

(51) Int. Cl.[7] ..... B66B 1/34
(52) U.S. Cl. ..... 187/292; 182/391
(58) Field of Search ..... 187/292, 391, 187/394, 401

(56) References Cited

U.S. PATENT DOCUMENTS 5,027,925 * 7/1991 Kahkipuro ..... 187/115
5,544,721 * 8/1996 Roberts ..... 187/394
5,749,444 * 5/1998 Skalski ..... 187/409
5,866,861 * 2/1999 Ramjamani et al. ..... 187/292
5,896,949 * 4/1999 Hamdy et al. ..... 187/292
5,929,399 * 7/1999 Jamieson et al. ..... 187/391

FOREIGN PATENT DOCUMENTS

10245178-A * 9/1998 (JP) .

OTHER PUBLICATIONS

Yoshiaki Yamazaki, Masao Tomisawa, Kouji Okada, and Yoshiki Sugiyama, "Vibration Control of Super–High–Speed Elevators", Japanese Society of Mechanical Engineers International Journal, Series C, vol. 40, No. 1, 1997.

* cited by examiner

*Primary Examiner*—Jonathan Salata

(57) ABSTRACT

An elevator cab control system directly minimizes the lateral acceleration of an elevator cab floor, or platform, relative to the elevator car frame by implementing electromagnets between the cab floor and the car frame. The electromagnets are controlled in a closed-loop feedback manner by signals from accelerometers.

5 Claims, 5 Drawing Sheets

ELEVATOR CAB FLOOR ACCELERATION CONTROL SYSTEM

TECHNICAL FIELD

The present invention relates to elevator systems and, more particularly, to an elevator passenger car active-acceleration control system that controls the acceleration of the elevator car floor.

BACKGROUND OF THE INVENTION

To enhance passenger comfort, elevator systems require acceleration control systems to suppress accelerations, e.g., vibrations, transmitted from various components of the elevator system to the elevator car. Most elevator systems provide one or more means for absorbing or dampening forces applied to an elevator car by surrounding structures. For example, friction dampers may be applied to roller guides. Such solutions add to the cost and space requirements of the overall system, and are subject to high levels of wear. Active-guidance control systems have been employed to reduce or eliminate certain types of vibrations associated with elevator car movement.

One factor that greatly affects elevator car ride quality is lateral vibration of the elevator car with respect to the hoistway or elevator guide rails. Lateral vibrations can be caused by aerodynamic forces acting directly on the elevator car during movement. Lateral vibrations may also be attributable to suspension forces resulting from imperfections in the manufacture and installation of the hoistway guide rails, or due to misalignment of the rails caused by building settlement.

Certain known systems stabilize the elevator car frame with respect to the hoistway guide rails. Systems of this type require a suspension-centering subsystem that adds weight, cost, and complexity to the overall elevator system. These types of systems are often subject to reliability problems. In addition, they typically consume large amounts of electrical power which requires additional cost and which presents thermal concerns. By stabilizing only the elevator car frame with respect to the hoistway guide rails, there still remains relative movement or vibration between the elevator car frame and the cab floor, on which the passengers stand.

At least one known system described in a publication, "Improving Control of Super-High-Speed Elevators", Japan Society of Mechanical Engineers International Journal, Series C, Vol. 40, No. 1 1997 (the JSME Article), attempts to control lateral vibration in an elevator car by using an actuator attached between the elevator car frame and the elevator cabin. The intent is to isolate the elevator cabin from vibrations to which the elevator car frame is subject. The results are somewhat mediocre, however, as described in FIGS. 18 and 19 of the JSME Article, because the ballscrew actuator used in the system introduces high frequency vibrations. In addition, the ballscrews will undergo mechanical wear, limiting life, increasing noise and decreasing maintainability. Moreover, the prior art system described in the JSME Article is subject to controllability problems due to stiction, friction and backlash of its mechanically contacting components.

OBJECT AND SUMMARY OF THE INVENTION

It is an object of the present invention to provide a system for controlling lateral elevator cab floor vibration for improving ride quality using an active-guidance system. It is a further object of the present invention to provide such a system that provides superior and efficient performance over known, prior systems and that overcomes the shortcomings of such prior systems. These objects and others are achieved by the present invention described herein.

The present invention elevator cab acceleration control system directly minimizes the lateral vibration of an elevator cab floor, e.g., an elevator platform, by implementing electromagnets between the cab floor and the car frame in a novel fashion. The electromagnets are controlled in a closed-loop feedback manner by signals from accelerometers. The present invention system eliminates the cost, complexity and structural requirements of the prior art systems described above. In contrast to the prior art systems, the present invention system provides direct vibration control to the cab floor. Because the present invention system directly controls the vibration of the cab floor rather than the relatively heavy elevator car frame, the active vibration actuators employed have a much lower force requirement and thus a lower power supply requirement. The present invention system is of simple construction and can be easily retrofit on existing equipment.

The present invention elevator cab acceleration control system generally comprises three axes of vibration feedback utilizing accelerometers, a control system, vibration-suppressing actuators in the form of electromagnets, and an accompanying power supply. For each axis, an arrangement of an accelerometer and a reaction plate are attached to brackets that are fixed to a rigid member of the elevator cab floor, e.g., the platform structure. The rigid member may be, for example, a centrally-located platform-stiffening member. Electromagnets are mounted to a rigid member of the car frame structure, such as a safety plank. The electromagnets are arranged to cooperate with the reaction plates to control acceleration of the elevator platform. Power supply and control modules for the electromagnets and the accelerometers can be located in a variety of locations depending on such factors as safety and convenience for service personnel.

As the elevator cab platform vibrates in a given axis (postwise axis, front-to-back axis on left side of car, and front-to-back axis on right side of car), the vibration is detected by the accelerometer and an electrical signal proportional to the vibration level is fed to the control system. The control system varies current to the electromagnet to control the force required to nullify the vibration (i.e., acceleration) of the platform. The force is a function of the cab mass transfer function and vibration level. Closed-loop feedback of the cab vibration to the control system ensures that the electromagnetic force level signaled by the control system is continuously adjusted to provide the proper amount of vibration-attenuating force.

DESCRIPTION OF THE PREFERRED EMBODIMENT

Figure 1:
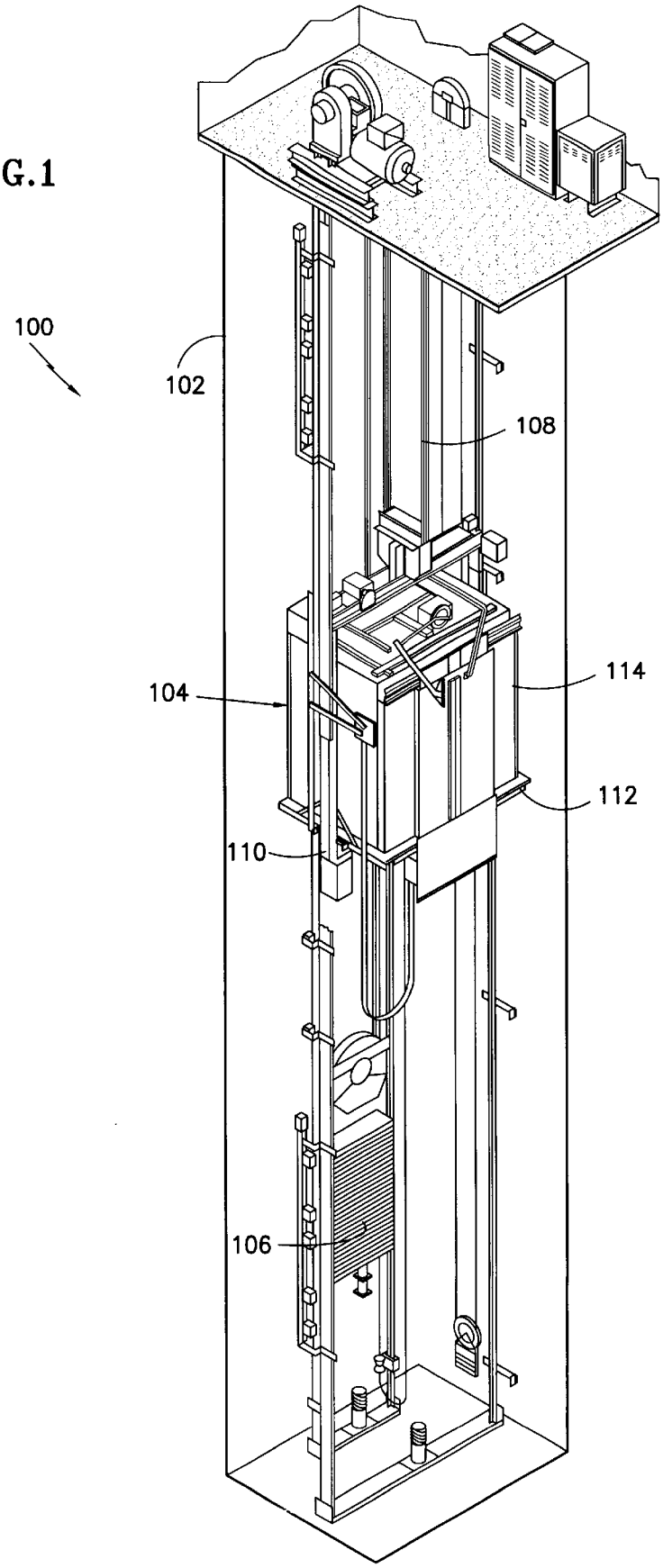
FIG.1 is a schematic, partial isometric view of an elevator system of the type with which the present invention vibration control system is implemented.

A typical elevator system (100) is illustrated in FIG. 1, comprising an elevator hoistway (102), having an elevator car (104) positioned therein for vertical movement. The elevator car (104) is suspended and coupled to a counterweight (106) for relative movement therewith through a set of elevator ropes (108).

The elevator car (104) includes a car frame (110), a platform (112), and a cab (114) or cabin. The elevator cab (114) typically comprises four vertical walls and a roof. The platform (112) typically comprises the elevator cab floor upon which passengers stand. Although the cab floor is described as being separate from but rigidly connected to the cab (114), it will be clear to one skilled in the art that the cab floor may be an integral part of the cab (114). Moreover, the elevator platform (112) may be a separate supporting structure upon which the elevator cab floor is rigidly mounted.

Figure 2:
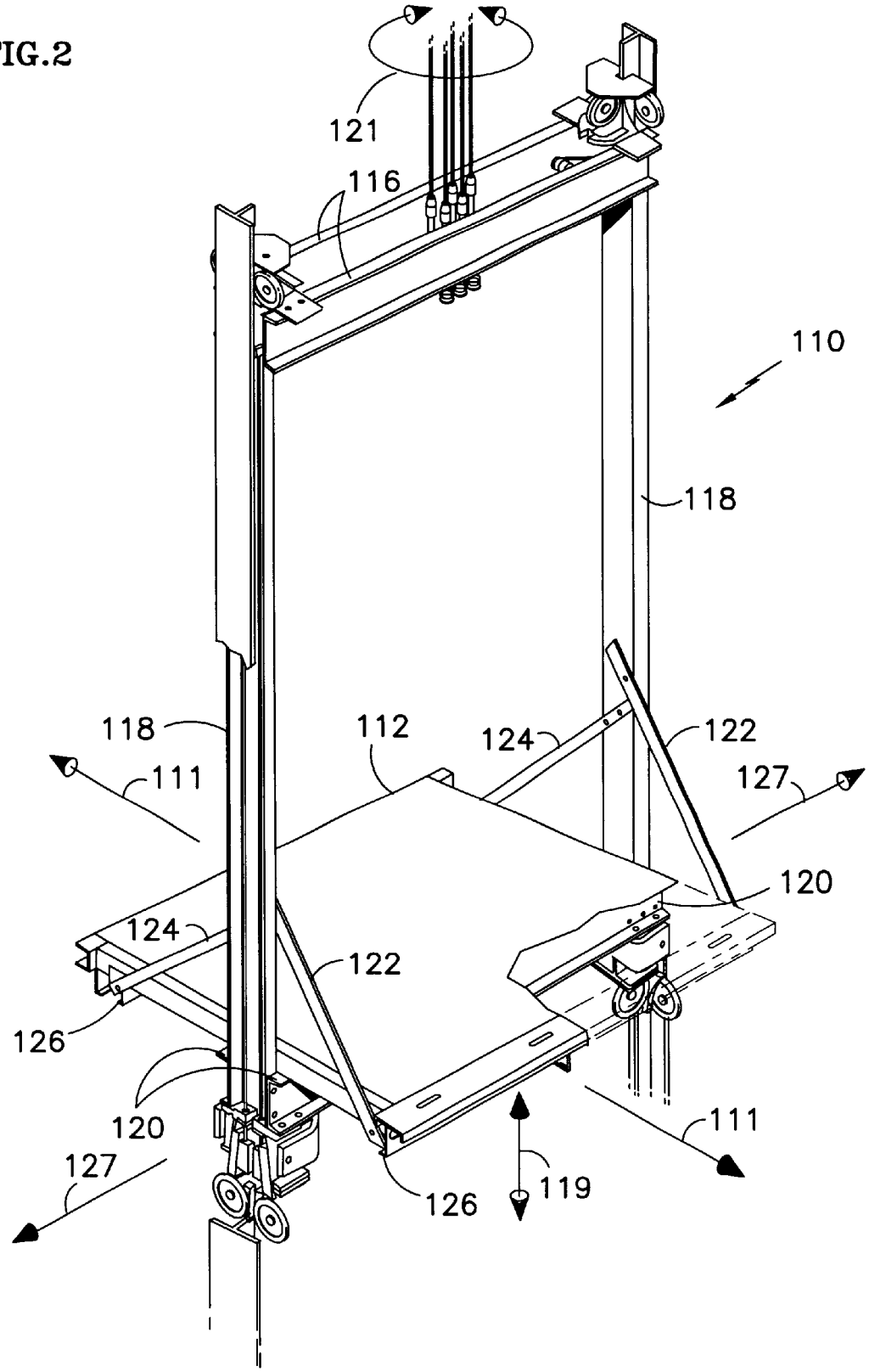
FIG. 2 is a schematic, partial isometric view of an elevator car frame of the type with which the present invention vibration control system is implemented.

Referring to FIG. 2, the car frame (110) includes a crosshead (116), a pair of vertically extending stiles (118) joined at the top by the crosshead (116), and one or more safety planks (120) joining the stiles (118) at the bottom. The platform (112) is positioned atop the safety planks (120) and attached to the stiles (118) by brackets (122, 124) connected to a support frame (126).

Figure 3:
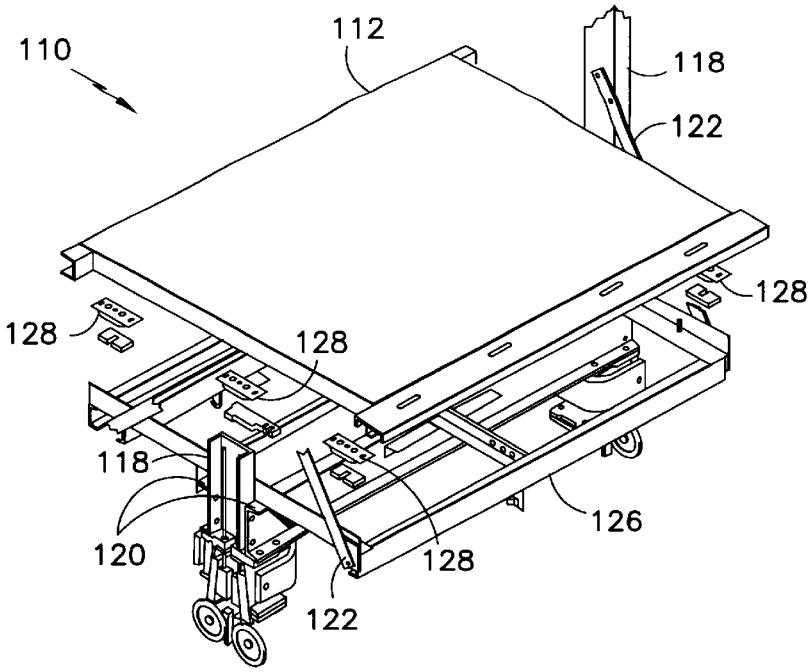
FIG. 3 is a schematic, partial isometric view of an elevator platform of the type with which the present invention vibration control system is implemented.

As shown in FIG. 3, a set of rubber sound isolation pads (128) are positioned between the platform (112) and the support frame (126), and a set of sound isolation pads 129 are positioned between the platform (112) and where it rests on the safety planks (120). The sound isolation pads (128, 129) provide sound isolation and, to some extent, reduce the effect of car frame (110) vibration on the cab (114).

Figure 4:
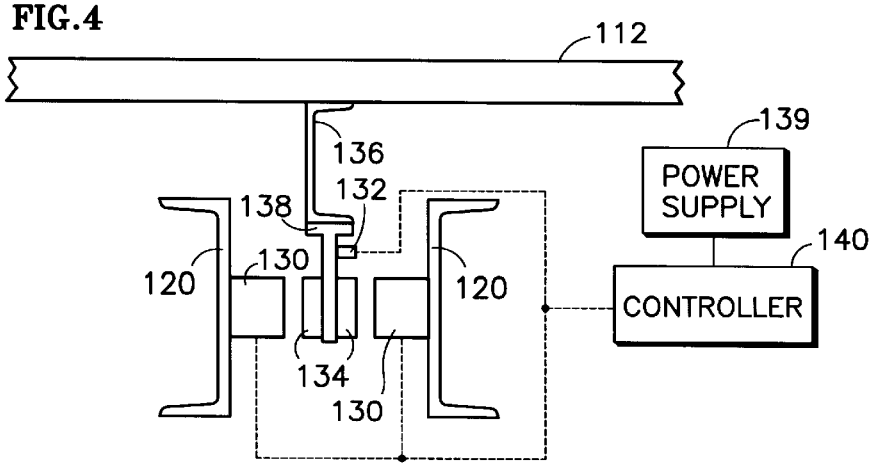
FIG. 4 is a schematic, partial side view of a first embodiment of the present invention vibration control system.

Referring to FIG. 4, a novel aspect of a first exemplary embodiment of the present invention system for controlling acceleration of an elevator cab floor, e.g., platform (112), along an axis defined as front-to-back axis (111, FIG. 2), perpendicular to the safety planks (120) is described. The system includes the placement of electromagnets (130) in between the safety planks (120) and a rigid member such as a stiffening-channel (136) fixed to the elevator platform (112). An accelerometer (132) and a set of reaction plates (134) are rigidly mounted to the platform (112) through the platform-stiffening channel member (136) and bracket (138). These components may be mounted in a different location. The accelerometer (132) and electromagnets (130) are connected to one or more power supply (139) and controller (140) sources.

Though the sensors, which measure acceleration, are described in this exemplary embodiment as accelerometers (132), other acceleration sensors may also be used. By way of example, a displacement sensor with an output signal which is processed over time through a second order derivative may be used to calculate acceleration.

Though the objects which react to the magnetic field of the electromagnets (130) are described in this exemplary embodiment as reaction plates (134), other reaction objects with different geometrical shapes may also be used, e.g., cubical or box shaped. Moreover, the optimal shape of the reaction objects are dependant on the shape of the electromagnets themselves. The reaction object comprises a magnetically permeable material (such as iron, steel or a synthetic magnetic alloy) which completes the magnetic circuit by providing a path of least resistance for the magnetic field generated by the electromagnets (130). The magnetic field is comprised of lines of magnetic flux which conduct through the magnetic circuit. The lines of flux pass from each electromagnet (130), across an air gap, through the related reaction object, i.e., reaction plate (134) in this embodiment, and back to the electromagnet (130), thus completing the magnetic circuit.

Although the electromagnets (130) are shown as mounted to the safety planks (120), they may be mounted to other areas of the car frame (110) as well, e.g., the stiles (118) or the support frame (126). Moreover, although the electromagnets (130) and the reaction plates (134) are described as rigidly mounted in opposing fashion to the car frame (110) and the platform (112) respectively, it will also be clear that they may be switched. That is, the electromagnets (130) may be mounted to the platform (112) and the reaction plate (134) may be opposingly mounted to the car frame (110).

Unlike prior art active guidance systems which stabilize the car frame (110) with respect to the elevator hoistway (102), the present invention stabilizes the elevator cab floor, i.e., platform (112). Moreover, unlike the prior art system described in the above-referenced JSME Article, the present invention utilizes non-contacting electromagnets as opposed to mechanically contacting components such as ball screws. The platform (112) and car frame (110) are moveable relative to each other as the platform sits on the isolation pads (128) disposed between the car frame (110) and the platform (112). Therefore, as electric current from the power supply (139) to the electromagnets (130) is varied by the controller (140) to control the strength of the magnetic field, the electromagnets (130) move the platform (112) via attraction of the magnetic reaction plate (134). Since the electromagnets (130) operate uni-directionally, a pair of magnets are usually required to provide bi-directional (push/pull) motion.

The isolation pads (128) are based on well-known standard sound-isolated elevator construction. Though they are described as being rubber pads, they may comprise any suitably compliant isolation device, e.g., a metallic or helical spring, or be of a suitable elastomeric material such as neoprene or polyurethane. The cab (114) is rigidly connected to the platform (112). Therefore, the cab (114)/platform (112) combination is moveable relative to the car frame (110) via deformation of the isolation pads (128).

As will be discussed more thoroughly hereinafter, the controller (140) takes the input from the accelerometer(s) (132), which defines the amplitude and frequency of the platform (112) vibration, and determines the necessary amount of current (and thus the magnetic strength) to supply to the electromagnets (130). Since the system uses closed-loop feedback (using the accelerometer feedback), this process is continuous so the current level is constantly and instantly adjusted to apply the proper amount of current.

One or more present invention arrangements of components of the type described with respect to FIG. 4 may be provided, depending on the size of the elevator car assembly and its tendency to rotate, as a result of vibration, about one or more vertical axes. If the elevator car assembly is relatively small, there may be less tendency for rotation about vertical axes and, thus, only one arrangement of the type described with respect to FIG. 4 may be sufficient for the front-to-back axis (111). If only one is implemented, it is preferable to mount it generally centrally with respect to the safety planks (120). If the elevator car assembly is relatively large, two or more of the present invention arrangements may be implemented.

Figure 5:
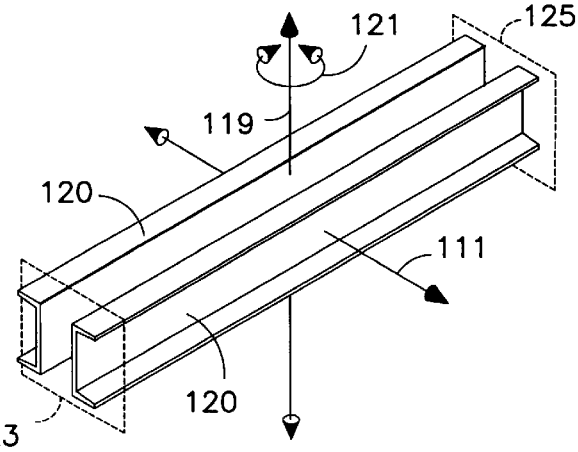
FIG. 5 is a schematic, partial isometric view of a pair of elevator safety planks of the type with which the present invention vibration control system is implemented.

Referring to FIG. 5, for example, each of the two end regions (123, 125) of the safety planks (120) can be equipped with the present invention assembly described in FIG. 4 to individually control vibrations bi-directionally along the front-to-back axis (111) and to cooperatively control the tendency of the elevator car assembly to rotate about one or more vertical axes, such as in a manner represented by the arrow (121) about the vertical axis (119).

Figure 6:
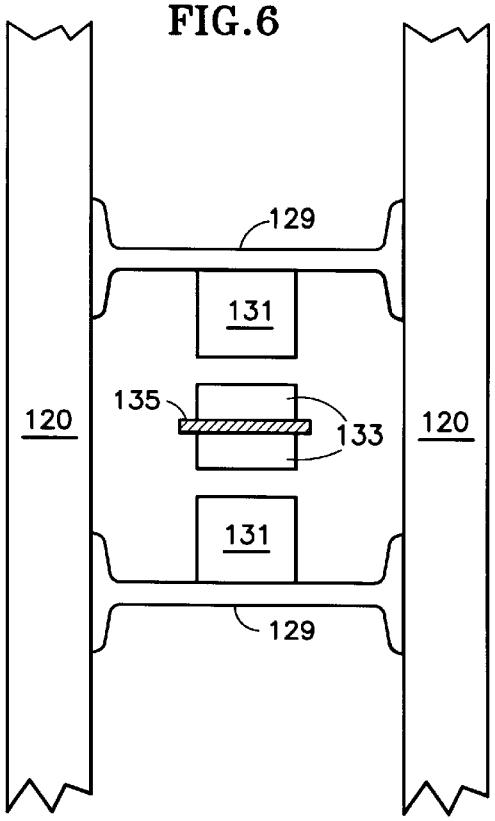
FIG. 6 is schematic, partial plan view of the first embodiment of the present invention vibration control system.
Figure 7:
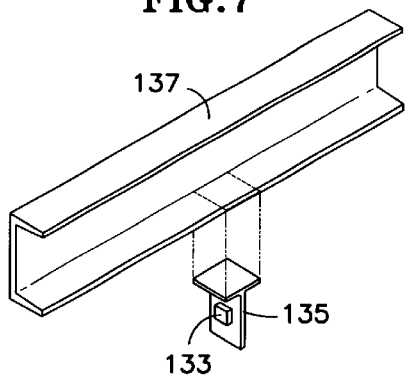
FIG. 7 is a schematic, partial isometric exploded view of a component of the present invention vibration control system.

In order to control vibration in the direction of the post-wise axis (127, FIG. 2), an assembly according to the present invention and illustrated in FIG. 6 is provided between the safety planks (120). A pair of magnet-mounting brackets (129) are rigidly mounted to the safety planks (120). The brackets (129) may be of I-beam cross-section or another suitable configuration. A set of electromagnets (131) are fixed to the brackets (129) and positioned to cooperate with a set of reaction plates (133) fixed to a plate-bracket (135). The plate-bracket (135) is attached to a platform-stiffening member (137), as shown in FIG. 7, which is fixed to the bottom surface of the elevator platform. More than one such present invention assemblies may be provided to control vibrations along the direction of the post-wise axis (127) by spacing them apart and orienting them along multiple axes that are parallel to the post-wise axis (127) shown. Such use of multiple-axis assemblies would have the same anti-rotation effect with respect to vertical axes as the arrangement described with respect to FIG. 5.

The present invention component arrangement of electromagnets, reaction plates and accelerometers may be implemented by mounting the components relative to the car platform and the car frame, respectively, by fixing each component to parts other than those specified in the preferred embodiments described above. For example, in an elevator system in which platform-stiffening members are not present, a mounting arrangement such as that illustrated in FIG. 8 may be implemented.

Figure 8:
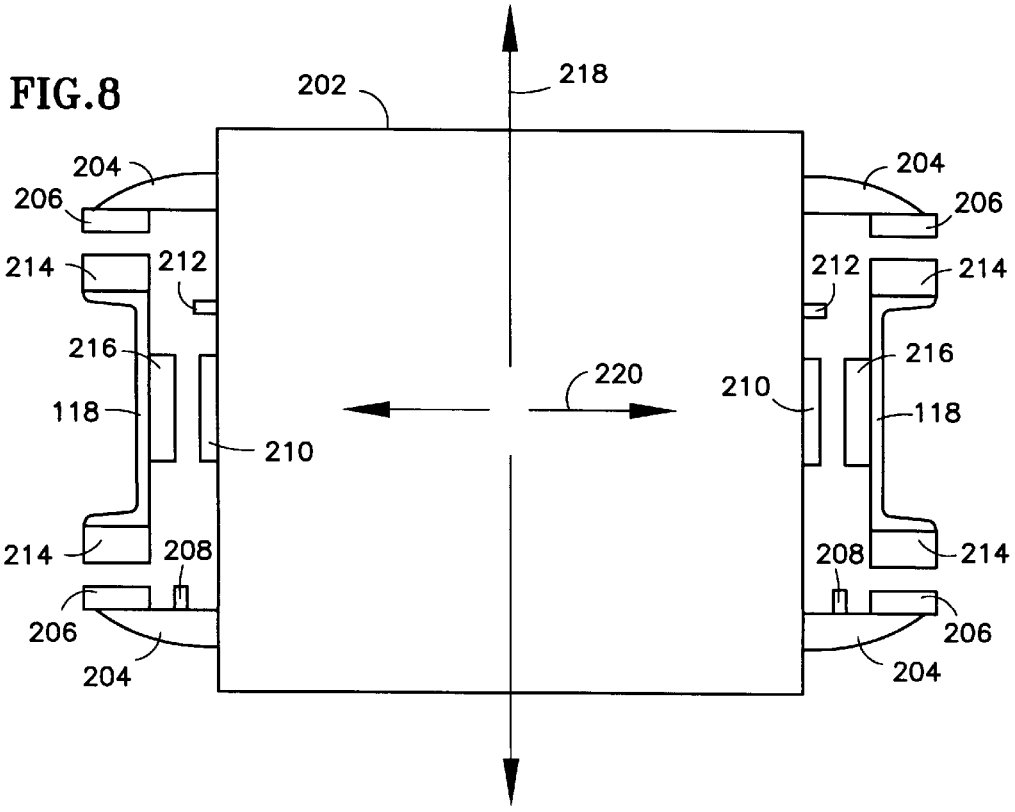
FIG. 8 is schematic, partial plan view of the first embodiment of the present invention vibration control system.

Referring to the schematic plan view of FIG. 8, a second exemplary embodiment of the present invention includes an elevator car platform (202) which is provided with side mounting brackets (204) arranged in pairs and fixed to the outer perimeter of the platform (202) for mounting first sets of magnetic reaction plates (206) and accelerometers (208). Second sets of magnetic reaction plates (210) and accelerometers (212) are mounted directly to the platform (202). The car frame stiles (118) are each provided with a first set of electromagnets (214) and a second set of electromagnets (216). The first set of reaction plates (206) and the first set of electromagnets (214) cooperate to control vibration along the front-to-back axis (218). The second set of reaction plates (210) and the second set of electromagnets (216) cooperate to control vibration along the post-wise axis (220). Rotation about one or more vertical axes perpendicular to a plane formed by the front-to-back axis (218) and the post-wise axis (220) is controlled by the first set of reaction plates (206) and electromagnets (214). As described with respect to the first embodiment, a power source (not shown) and controller (not shown) of conventional types are implemented to control the system in a similar manner.

Referring to FIGS. 3–7, during operation, as the elevator platform (112) vibrates in a direction along the front-to-back axis (111), the vibration is detected by the accelerometer (132). The accelerometer (132) generates an electric signal indicative of the vibration level and transmits it to the controller (140). In response, the controller (140) determines an appropriate level of force to be produced by the electromagnets (130) to nullify or counter the vibration, or acceleration, of the elevator platform (112). A signal indicative of the force determined by the controller (140) is transmitted to the electromagnets (130) and the force is then applied by the electromagnets (130) to the reaction plates (136). Closed-loop feedback of the elevator platform (112) vibration to the controller (140) ensures that the electromagnetic force signaled by the controller (140) is continuously adjusted to provide the proper amount of vibration-attenuating force.

Figure 9:
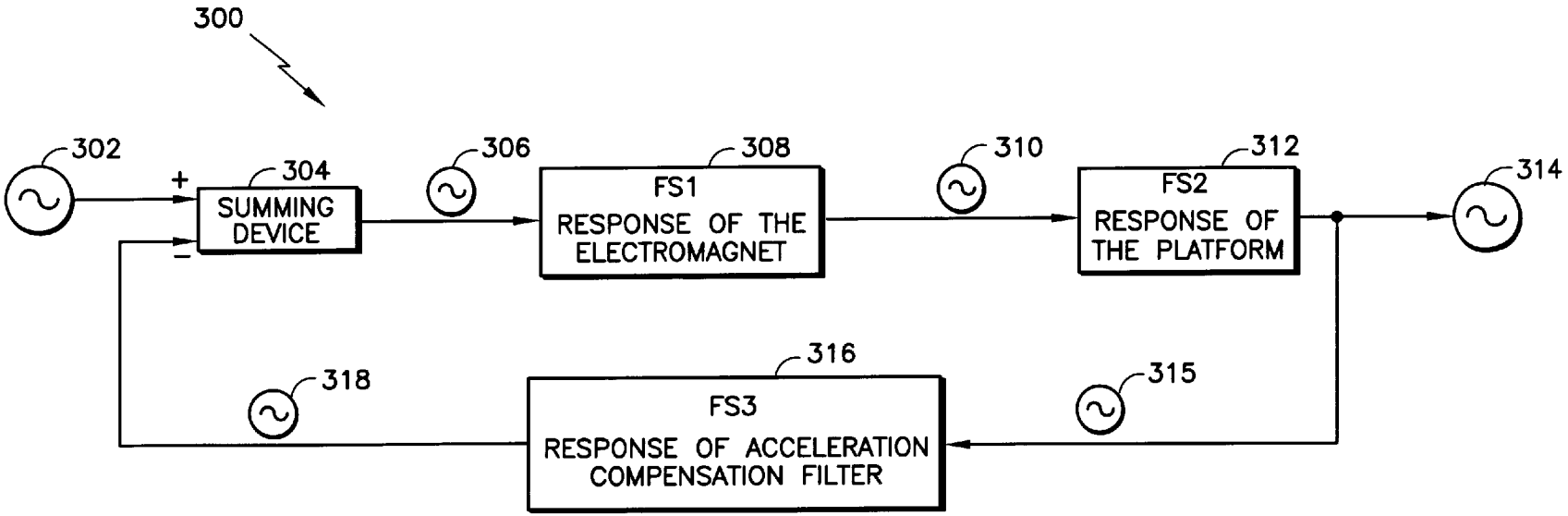
FIG. 9 is a schematic block diagram of the closed loop feedback system of the present invention vibration control system.

Referring to FIG. 9, because exemplary embodiments of the present invention use a closed-loop feedback system (300) to continuously monitor and adjust force output, there is no need for pre-stored data other than a vibration compensation filter which is part of the controller (140).

The closed loop feedback system (300) is comprised of three primary transfer functions, i.e., functions that are a ratio of the response of a system or sub-system to a given excitation. The three primary transfer functions are:

1) FS1 (308), which is indicative of the response of the electromagnet (130) sub-system to an acceleration command;
2) FS2 (312), which is indicative of the response of the platform (112), i.e., the elevator cab floor, sub-system to the force applied by the electromagnets (130); and
3) FS3 (316), which is indicative of the response of an acceleration compensation filter within controller (140) to the measured acceleration signal (314) from accelerometer (132). The accelerometer (132) being attached to the elevator cab floor.

The closed loop feedback system (300) includes an acceleration command signal (302) (typically software generated), whose target is fixed at zero lateral acceleration for the elevator cab floor. The acceleration command signal (302) is input into summing device (304), which in turn outputs a difference acceleration error signal (306). The difference acceleration signal (306) is input into FS1 (308) to adjust the current to the electromagnets (130) and produce a magnetic force output signal (310). The magnetic force output signal (310) is input into FS2 (312), which controls, e.g., nullifies, the acceleration (314) of the platform (112), i.e., the elevator cab floor. The accelerometer (132) attached to the platform (12) produces a measured acceleration signal (315) which is input into FS3 (316), the vibration compensation filter transfer function. FS3 (316) produces a vibration compensation signal (318), which is fed back and compared to the acceleration command signal (302) at summing device (304) to complete the closed loop system (300).

In either of the first or second embodiments, the location of the controllers and the power supplies may vary according to the specific structure into which they are integrated. Wiring for each can be run through conduits to and from the controllers, the electromagnets and the accelerometers. Alternatively, the controllers and power supplies can be mounted on the elevator car assemblies. Preferably, the accelerometers are always located at or as close as possible to the part of the structure for which vibration control is desired, in order to eliminate or minimize performance problems attributable to flexible structures causing resonances between the accelerometer and the part for which control is desired.

While the preferred embodiments have been herein described, it is understood that various modification to and deviation from the described embodiments may be made without departing from the scope of the presently claimed invention.

What is claimed is:

1. An elevator comprising:

a frame supported by a moveable rope for vertical motion between a pair of guide rails;

a cab having a platform and supported solely by compliant sound isolation devices disposed between said frame and said platform, said platform being moveable with respect to said frame as a consequence of deformation of said isolation devices;

a pair of electromagnets disposed in fixed relation to one of said platform and said frame;

a pair of magnet reaction objects disposed in fixed relation to the other one of said platform and said frame with an air gap disposed between each reaction objects and a corresponding one of said electromagnets, wherein each said set of air gap, reaction object and electromagnet complete a magnetic circuit for a magnetic field generated by the corresponding electromagnet, the magnetic field of one of said sets being parallel to the magnetic field of the other of said sets along a first axis, said electromagnets and magnet reaction objects being disposed so that one of said magnetic fields will move said platform in one direction along said axis and the other of said magnetic fields will move said platform in a direction opposite to said one direction;

an acceleration sensor disposed in fixed relation to said platform, said acceleration sensor generating an acceleration signal indicative of acceleration of the elevator cab platform in a direction parallel to the magnetic fields extending across said air gaps; and a controller responsive to said acceleration signal to vary the strength of the magnetic fields generated by each of said electromagnets to provide bi-directional control of acceleration of said platform.

2. An elevator according to claim 1 further comprising:

a second set of electromagnets disposed in fixed relation between said platform and said frame with the flux in said second air gaps disposed along a second axis;

a second acceleration sensor disposed in fixed relation to said platform, said second sensor generating a second signal indicative of acceleration of the elevator cab floor along said second axis; and said controller responsive to said second acceleration signal to provide bi-directional control of the acceleration of said platform along said second lateral axis.

3. An elevator according to claim 2 wherein said first and second axes are substantially perpendicular.

4. An elevator according to claim 3 wherein:

said first axis comprises a front to back axis of said platform; and said second axis comprises a postwise axis of said platform.

5. An elevator according to claim 4 wherein said first and second axes are substantially parallel to each other and said controller provides control of rotation of said platform about a vertical axis perpendicular to said platform.

* * * * *